US007206534B2

(12) United States Patent
Murakami

(10) Patent No.: US 7,206,534 B2
(45) Date of Patent: Apr. 17, 2007

(54) PROCESS CARTRIDGE, DEVELOPING CARTRIDGE AND GRIPPING PART THEREFOR

(75) Inventor: Ryuta Murakami, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 10/968,020

(22) Filed: Oct. 20, 2004

(65) Prior Publication Data

US 2005/0191084 A1 Sep. 1, 2005

(30) Foreign Application Priority Data

Feb. 27, 2004 (JP) ..... 2004-055433

(51) Int. Cl.
*G03G 15/08* (2006.01)
*G03G 21/18* (2006.01)

(52) U.S. Cl. ..... 399/103; 399/12; 399/106; 399/111

(58) Field of Classification Search ..... 399/103, 399/106, 12, 111, 119, 120, 107, 110, 262
See application file for complete search history.

(56) References Cited

U.S. PATENT DOCUMENTS

| | | | | |
|---|---|---|---|---|
| 5,937,237 | A * | 8/1999 | Nonaka et al. | 399/106 |
| 6,735,405 | B2 | 5/2004 | Yokoi et al. | 399/209 |
| 6,804,476 | B2 * | 10/2004 | Yokoi et al. | 399/103 |
| 6,836,639 | B2 | 12/2004 | Karakama et al. | 399/351 |
| 6,898,392 | B2 | 5/2005 | Karakama et al. | 399/90 |
| 2002/0064391 | A1 * | 5/2002 | Sato | 399/103 |
| 2003/0156855 | A1 | 8/2003 | Nittani et al. | 399/106 |
| 2004/0134070 | A1 | 7/2004 | Komatsu et al. | 29/895.2 |
| 2005/0249519 | A1 * | 11/2005 | Chadez | 399/106 |

FOREIGN PATENT DOCUMENTS

| | | | |
|---|---|---|---|
| JP | 08-339150 | A * | 12/1996 |
| JP | 11-184351 | | 7/1999 |
| JP | 2002-278417 | A * | 9/2002 |
| JP | 2003-241495 | | 8/2003 |

* cited by examiner

*Primary Examiner*—Sophia S. Chen
(74) *Attorney, Agent, or Firm*—Fitzpatrick, Cella, Harper & Scinto

(57) ABSTRACT

A process cartridge is detachably mountable to a main assembly of an electrophotographic image forming apparatus. The cartridge includes a frame; an electrophotographic photosensitive drum; a developing device for developing an electrostatic latent image formed on the drum; a developer accommodating portion for accommodating a developer for developing the latent image; a developer supply opening for supplying the developer from the accommodating portion to the developing device; a for unsealably sealing the opening; a grip member for being gripped when the sealing member is pulled to unseal the opening; and a grip member mounting portion separably mounted on the frame. The grip member has a stopper for preventing the cartridge from entering the main assembly by abutment to a part of the main assembly when the cartridge is being mounted to the main assembly with the sealing member mounted on the frame.

6 Claims, 16 Drawing Sheets

(a)

(b)

PROCESS CARTRIDGE, DEVELOPING CARTRIDGE AND GRIPPING PART THEREFOR

FIELD OF THE INVENTION AND RELATED ART

The present invention relates to a process cartridge and a development cartridge, which are removably mountable in the image assembly of an electrophotographic image forming apparatus. It also relates to a member (tab) with which a process cartridge and a development cartridge are provided, and which are used for pulling out a removable sealing member for sealing a developer supply hole with which a process cartridge and a development cartridge are provided.

Here, an electrophotographic image forming apparatus is apparatus for forming an image on a recording medium with the use of an electrophotographic image forming method. It includes, for example, an electrophotographic copying machine, an electrophotographic printer (laser printer, LED printer, etc.), a facsimile machine, a word processor, etc.

A process cartridge means a cartridge which is removably mountable in the main assembly of an electrophotographic image forming apparatus, and in which a minimum of a developing means, and an electrophotographic photosensitive drum, are integrally placed in order to make the developing means and photosensitive drum removably mountable in the main assembly of an electrophotographic image forming apparatus.

A development cartridge means a cartridge which comprises a developing means, stores developer, and is removably mountable in the main assembly of an electrophotographic image forming apparatus.

A process cartridge system has long been employed in the field of an electrophotographic image forming apparatus which uses an electrophotographic image formation process.

A process cartridge system enables a user to maintain an electrophotographic image forming apparatus by replacing a cartridge by himself, without relying on a service person, improving substantially an electrophotographic image forming apparatus in terms of operational efficiency. Thus, a process cartridge system has been widely used in the field of an electrophotographic image forming apparatus.

A process cartridge comprises: a developer storage frame, as a developer storage portion, in which developer is stored; and a developing means supporting frame which supports a developing means. Between the developer storage frame and developing means supporting frame, there is a hole through which developer is conveyed from the developer storage frame to the developing means supporting frame. Until a process cartridge is used for the very first time, this hole is kept sealed with a sealing member (which hereinafter may be referred to simply as seal), preventing the developer from moving into the developing means supporting frame; the developer remains in the developer storage frame. Thus, when a process cartridge is mounted into an electrophotographic image forming apparatus for the very first time, a user is to pull out the seal to unseal the hole to allow the developer to move into the developing means supporting frame, that is, to ready the cartridge for image formation.

Such a seal is provided with a handle (tab) which is attached to the portion of the seal exposed from a cartridge to allow the seal to be pulled out. In other words, the tab is for a user to grasp when removing the seal. Some of the tabs are known to be elongated in the lengthwise direction (direction in which sealing member is to be pulled), in order to prevent a user from forgetting to pull out the seal. More specifically, they are elongated so that unless they are removed from the process cartridge, they interfere with the main assembly of an electrophotographic image forming apparatus, preventing the cartridge from being inserted into the main assembly (Japanese Laid-open Patent Application 2003-241495).

On the other hand, it has been known that in order to improve a cartridge in shipment efficiency, some process cartridges are structured so that they can be mounted into the main assembly of an electrophotographic image forming apparatus, without removing the seal, at the time of shipment (Japanese Laid-open Patent Application 11-184351).

Thus, the need rose for preparing two kinds of process cartridges: a process cartridge of a first type and a process cartridge of a second type. The process cartridge of the first type is distributed independently from an electrophotographic image forming apparatus, and cannot be mounted into the main assembly of an electrophotographic image forming apparatus unless its seal is removed, whereas the process cartridge of the second type is mountable into the main assembly of an electrophotographic image forming apparatus without removing its seal, and is mounted into the main assembly before the main assembly is shipped out. Thus, the frame of the first type process cartridge had to be manufactured so that it would have a regulating portion, that is, a portion which prevents the cartridge from being mounted into the main assembly of an electrophotographic image forming apparatus, unless it is removed, and the frame of the second process cartridge had to be manufactured so that it would not have such a regulating portion. In other words, it was necessary to manufacture two kinds of process cartridge frames, adding to manufacture cost.

SUMMARY OF THE INVENTION

The primary object of the present invention is to provide a process cartridge and a development cartridge, the developer supply holes of which are kept sealed with a sealing member removably attached to their frames, and which have a sealing member removal handle (tab) to which one of a plurality of cartridge type differentiation members is attachable to prevent them from being inserted into the main assembly of an electrophotographic image forming apparatus while the sealing member for keeping their developer supply holes sealed remains attached, and also, to provide cartridge type differentiation members selectively attachable to the sealing member removal handle (tab).

Another object of the present invention is to provide a process cartridge and a development cartridge, the developer supply holes of which are kept sealed with a sealing member removably attached to their frames, and which have a sealing member removal handle (tab) to which a cartridge type differentiation members, which prevent them from being inserted into the main assembly of an electrophotographic image forming apparatus while the sealing member for keeping the developer supply hole of the process cartridge sealed remains attached, or a cartridge type differentiation member which allows them to be inserted into the main assembly of an electrophotographic image forming apparatus while the sealing member remains attached, can be selectively attached, and also, to provide such cartridge type differentiation members selectively attachable to the sealing member removal handle (tab).

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge, development cartridge, and cartridge type differentiation member, in each of the preferred embodiments of the present invention will be described with reference to the appended drawings.

Embodiment 1

Figure 1:
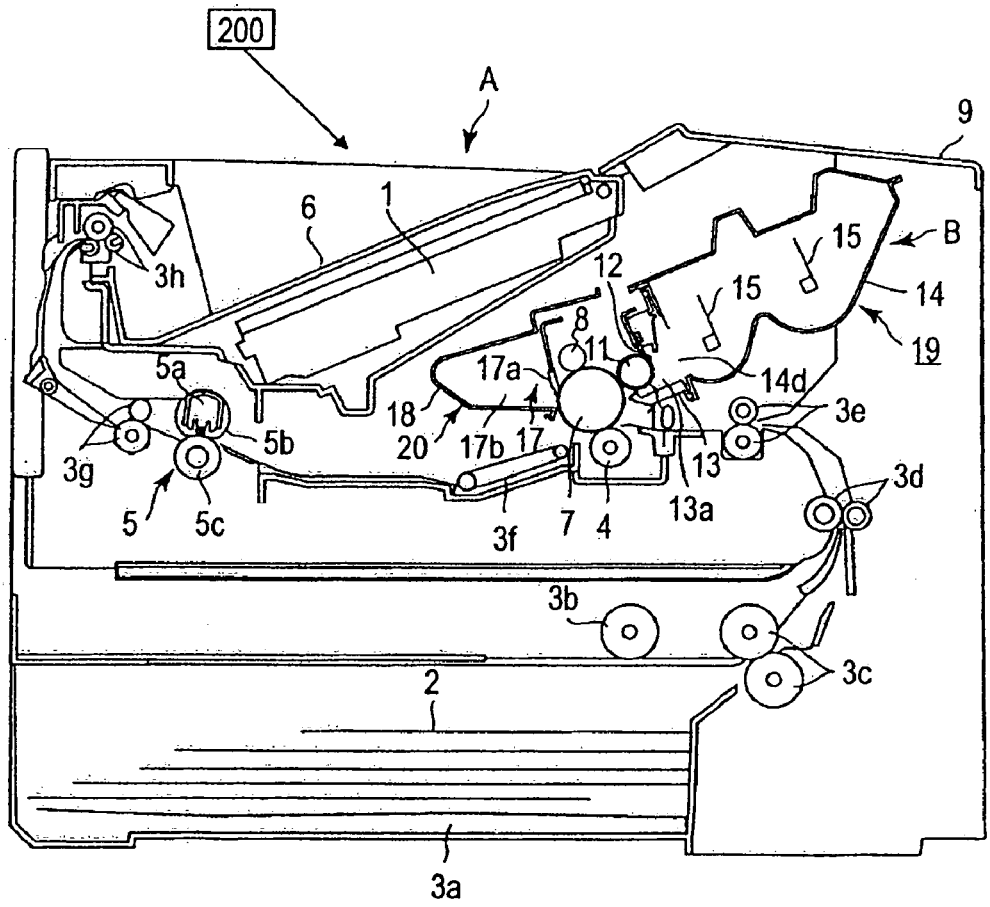
FIG. 1 is a sectional view of one of the electrophotographic image forming apparatus compatible with the process cartridge in one of the preferred embodiments of the present invention, showing the general structure thereof.

First, referring to FIG. 1, a typical electrophotographic image forming apparatus in which the process cartridge B in this embodiment of the present invention is removably mountable will be described. In this case, the electrophotographic image forming apparatus is described with reference to an electrophotographic laser beam printer 200 which forms an image on a recording medium 2 with the use of an electrophotographic image formation process.

In the following description of the preferred embodiments of the present invention, the widthwise direction of the cartridge B means the direction in which the cartridge B is mounted into, or dismounted from, the main assembly A of the printer 200. In this embodiment, the widthwise direction of the cartridge B is parallel to the direction in which the recording medium 2 is conveyed. The lengthwise direction of the process cartridge B means the direction intersecting (virtually perpendicular) to the direction in which the cartridge B is mounted into, or removed from, the main assembly A. The lengthwise direction is parallel to the surface of the recording medium 2, and intersects the direction in which the recording medium 2 is conveyed.

Figure 2:
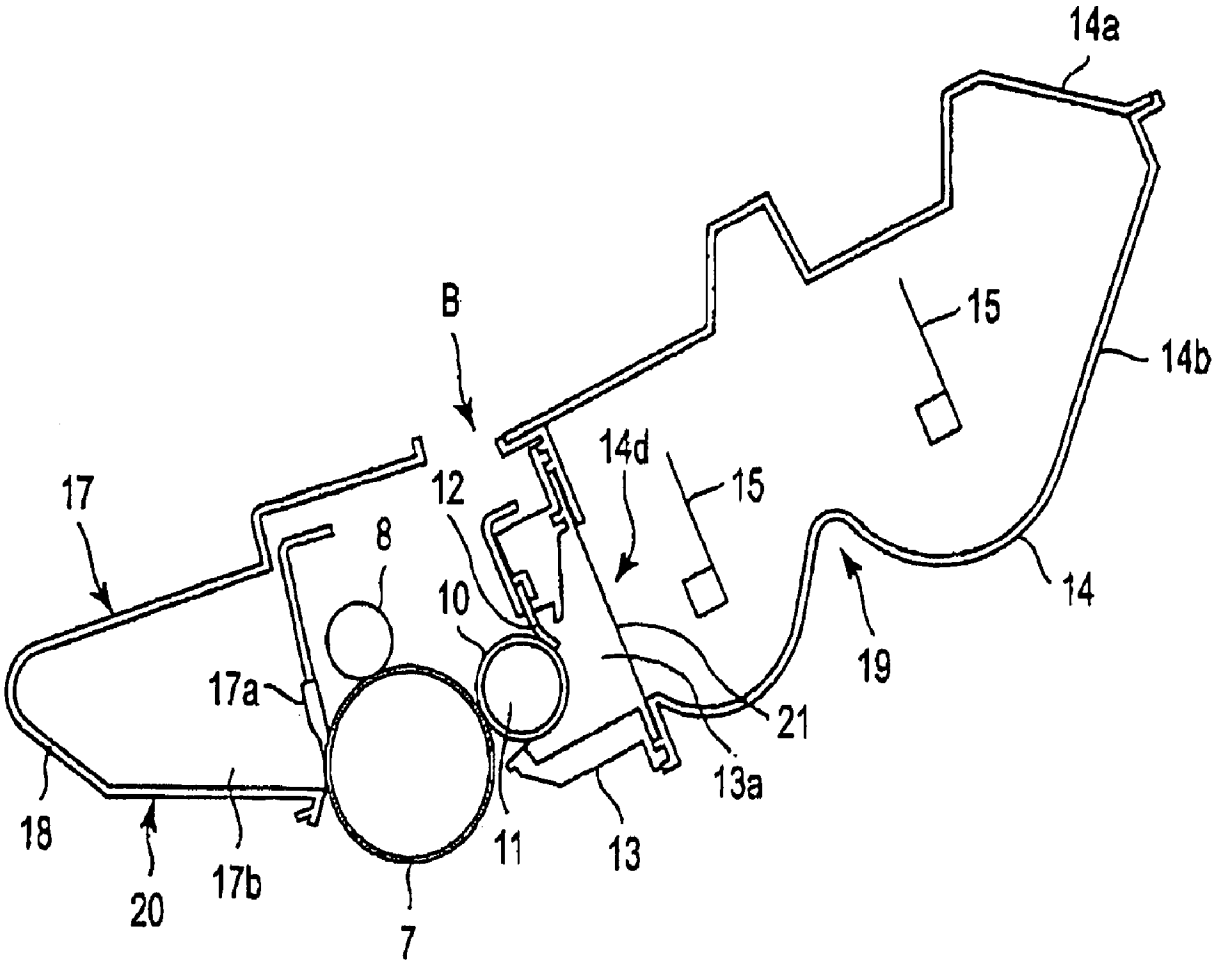
FIG. 2 is a sectional view of the process cartridge in the preferred embodiment of the present invention, showing the general structure thereof.

Referring to FIG. 2, the cartridge B, which is removably mountable in the apparatus main assembly A, integrally comprises a charging means and/or a developing means. In other words, the cartridge B is an integral combination of a development unit 19 and a photosensitive member unit 20. A developer storage frame 14 as a developer storage portion, and a developing means supporting frame 13, are welded to each other. The development unit 19 comprises a development roller 10 as a developing means, a development blade as a developing means, etc. The photosensitive member unit 20 comprises an electrophotographic photosensitive member (photosensitive drum) 7 in the form of a drum, a cleaning means 17, a charge roller 8 as a charging means, and a drum supporting frame 18. The cleaning means 17 has a cleaning blade 17*a*. The photosensitive drum 7, cleaning means 17, and charge roller 8 are attached to the drum supporting frame 18.

The image formation process (electrophotographic image formation process) is carried out in the cartridge B after the cartridge B is mounted into the apparatus main assembly A. In the charging step in the image formation process, the photosensitive drum 7 is charged by the charge roller 8. Next, in the latent image formation step (exposure step), a beam of laser light is projected onto the peripheral surface of the photosensitive drum 7, while being modulated with the image formation data, from an optical means (exposing means) 1 located outside the cartridge B. As a result, an electrostatic latent image in accordance with the image formation data is formed on the peripheral surface of the photosensitive drum 7. Next, in the development step, the electrostatic latent image is developed by the aforementioned developing means into a visible image (image formed of developer) reflecting the latent image.

There is a developer sending member 15 in the developer storage frame 14. The developer sending member 15 sends the developer into the development chamber 13*a* of the developing means supporting frame 13 while stirring the developer. More specifically, as the developer sending member 15 is rotated, the developer in the developer storage frame 14 is sent toward the development roller 10 in the development chamber 13*a*.

Figure 5:
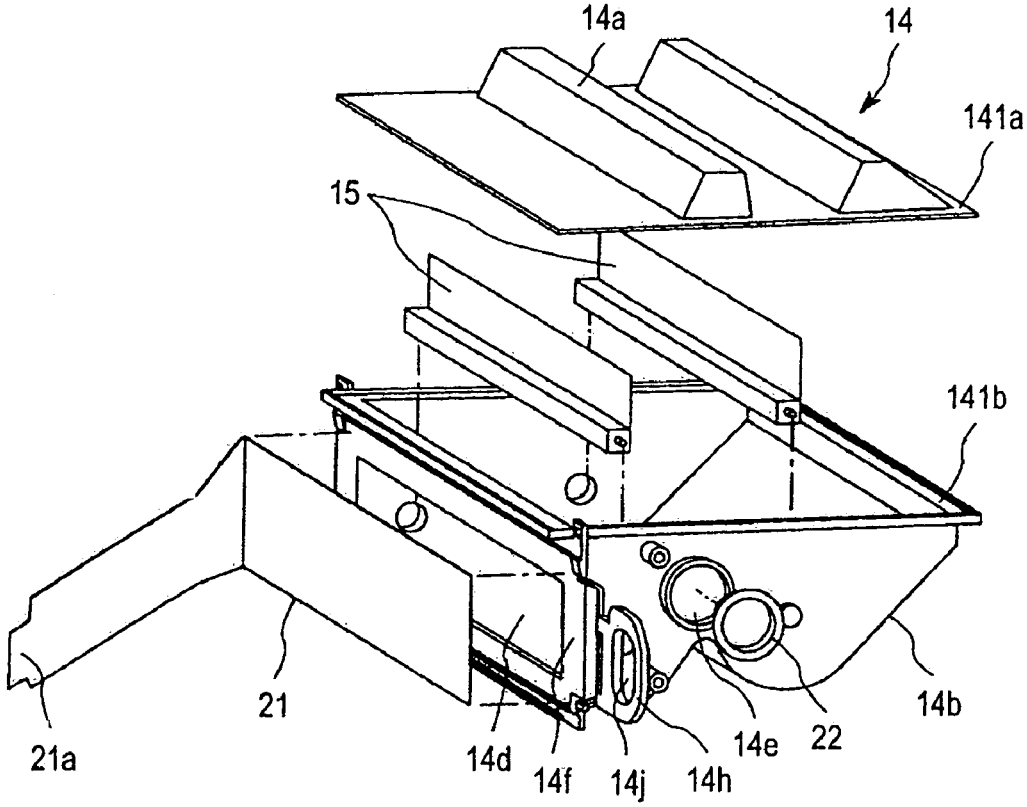
FIG. 5 is an exploded perspective view of the developer storage portion of the process cartridge in accordance with the present invention.

Referring to FIG. 5, the developer storage frame 14 is made up of a top portion 14*a* and a bottom portion 14*b*. The developer sending member 15 is in the bottom portion 14*b* of the developer storage frame 14. Further, the developer storage frame 14 is provided with a hole 14*d* through which the developer is sent to the developing means supporting frame 13. The developer storage frame 14 is also provided with a sealing member 21 (developer seal), which is welded to the developer storage frame 14 in a manner to seal the hole 14*d*.

The development unit 19 is provided with the development roller 10 as a developing means, which is supported by the developing means supporting frame 13. The development roller 10 contains a magnetic roller 11. Further, the development unit 19 is provided with the development blade 12 as a developer amount regulating member, which is supported by the developing means supporting frame 13. The development blade 12 forms a developer layer with a predetermined thickness, on the peripheral surface of the development roller 10 while frictionally charging the developer.

In the aforementioned development step, the developer is adhered to the peripheral surface of the development roller 10 as a developing means, and is conveyed by the rotation of the development roller 10 to the development station in which the peripheral surfaces of the development roller 10 and photosensitive drum 7 oppose each other. The development roller 10 is connected to a development bias circuit, making it possible to apply to the development roller 10 a development bias, which is a combination of AC and DC voltages. As the developer is supplied to the aforementioned development station, it is transferred by the aforementioned development bias onto the peripheral surface of the photosensitive drum 7 in the pattern of the latent image. As a result, a visible image is formed of the developer, on the peripheral surface of the photosensitive drum 7.

In synchronism with the formation of the developer image (image formed of developer) on the peripheral surface of the photosensitive drum 7, the recording medium 2 is conveyed to the transfer station, which is the area in which the portion of the peripheral surface of the photosensitive drum 7 exposed from the cartridge B opposes the transfer roller 4. The recording medium 2 has been placed in a cassette 3*a*. It is conveyed from the cassette 3*a* to the aforementioned transfer station, by a pickup roller 3*b*, and three pairs of conveyance rollers 3*c*, 3*d*, and 3*e*. In the transfer station, the transfer roller 4 as a transferring means is positioned. As the recording medium 2 is moved past the transfer station, voltage is applied to the transfer roller 4. As a result, the developer image formed on the photosensitive drum 7 is transferred onto the recording medium 2.

After the transfer of the developer image onto the recording medium 2, the recording medium 2 is sent to a fixing means 5 by way of a conveyance guide 3*f*. The fixing means 5 has a driver roller 5*c*, and a fixation roller 5*b* containing a heater 5*a*. The fixing means 5 applies heat and pressure to the recording medium 2, whereby the transferred developer image is fixed to the recording medium 2. Thereafter, the recording medium 2 is conveyed further by a pair of discharge rollers 3*g*, and is discharged by another pair of discharge rollers 3*h* into the delivery tray 6 which is on top of the apparatus main assembly A. The pickup roller 3*b*, three pairs of conveyance rollers 3*c*, 3*d*, and 3*e*, conveyance guide 3*f*, and two pairs of discharge rollers 3*g* and 3*h*, etc., make up the conveying means 3 for conveying the recording medium 2.

Meanwhile, the residual developer, or the developer remaining on the peripheral surface of the photosensitive drum 7 after the developer image transfer, is removed by the cleaning means 17 of the cartridge B. Then, the portion of the peripheral surface of the photosensitive drum 7 cleared of the residual developer is used for the next image formation process. The cleaning means 17 has an elastic cleaning blade 17*a* and a removed developer storage bin 17*b*. The elastic cleaning blade 17*a* is placed in contact with the peripheral surface of the photosensitive drum 7, and scrapes down the residual developer on the peripheral surface of the photosensitive drum 7. The removed developer storage bin 17*b* is where the developer scraped down from the photosensitive drum 7 is collected.

There is provided a hole 14*d* between the developer storage frame 14 and developing means supporting frame 13 of the development unit 19 of the cartridge B. This hole 14*d* is the hole through which the developer in the developer storage frame 14 is moved from the developer storage frame 14 toward the development roller 10, and which hereinafter will be referred to as developer supply hole 14*d*. Prior to the mounting of the cartridge B into the printer A, this developer supply hole 14*d* remains sealed with the seal 21, which is to be pulled out by a user prior to the mounting of the cartridge B into the printer A. With the removal of the seal 21, the developer is allowed to be moved into the developing means supporting frame 13, readying the image forming apparatus for image formation.

The apparatus main assembly A is shipped out of the factory, with the cartridge B of a second type mounted therein. The cartridge of the second type is designed so that it can be mounted into the apparatus main assembly A even if the seal 21 has not been removed. In other words, the cartridge of the second type is designed as a cartridge to be shipped out in the apparatus main assembly A. In comparison, the cartridge a first type is designed as a cartridge to be shipped out independently from the apparatus main assembly A, and cannot be mounted into the apparatus main assembly A unless the seal 21 has been removed. In other words, the cartridge of the first type is designed so that the removal of the seal 21 makes the cartridge of the first type mountable in the apparatus main assembly A.

In the past, therefore, the first and second type cartridges had to be different in the frame structure, adding to production cost. Further, a user sometimes forgot to remove the seal 21.

In comparison, in this embodiment of the present invention, the first and second type cartridges are made identical in frame structure, as shown in FIG. 2, and different in the cartridge type differentiation member to be attached to the seal removal tab. With this arrangement, it is possible to differentiate the first and second type cartridges in usage, simply by selectively attaching a cartridge type differentiation member of a first type or a cartridge type differentiation member of a second type, to the seal removal tab.

Next, the mounting of the cartridge B into the apparatus main assembly A, and its removal from the apparatus main assembly A, will be described.

Figure 3:
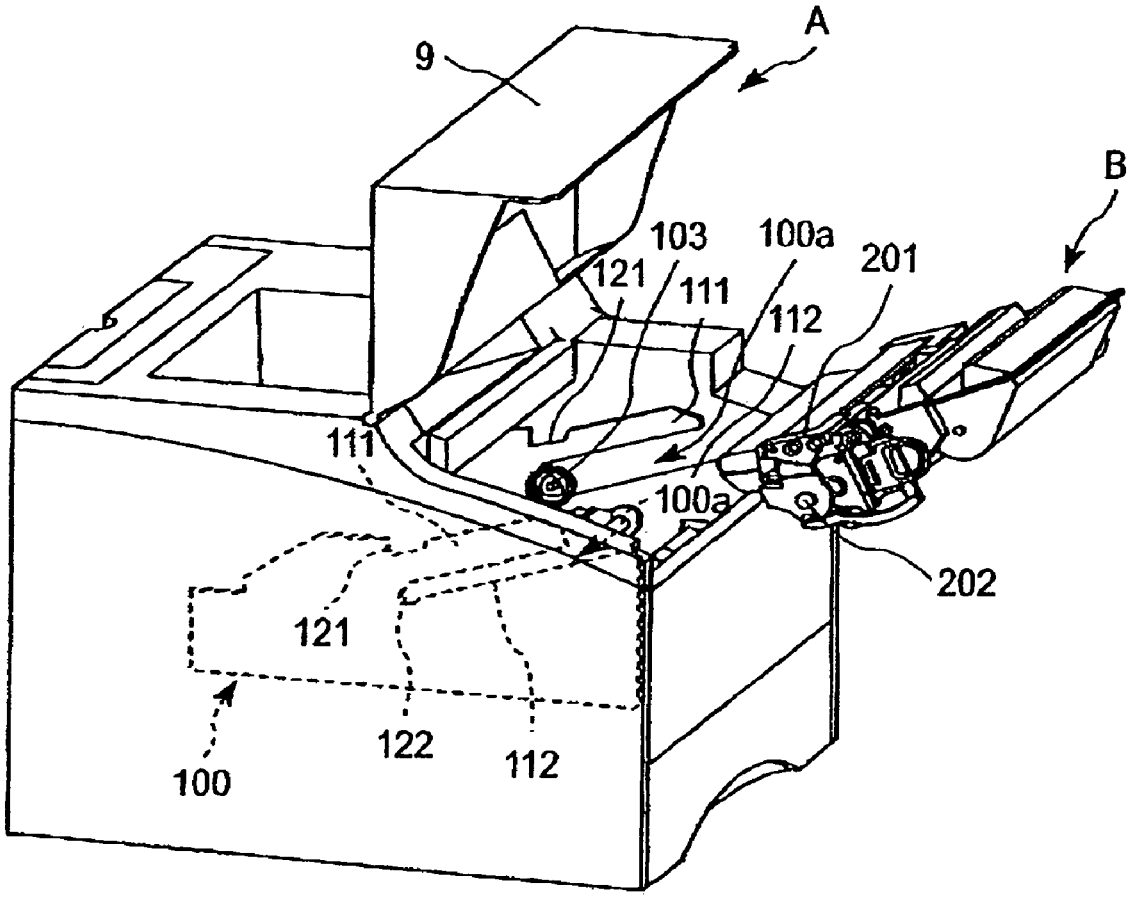
FIG. 3 is a perspective view of the main assembly of the electrophotographic image forming apparatus shown in FIG. 1, and the process cartridge shown in FIG. 2, showing how the process cartridge is mounted into, or removed from, the main assembly.
Figure 4:
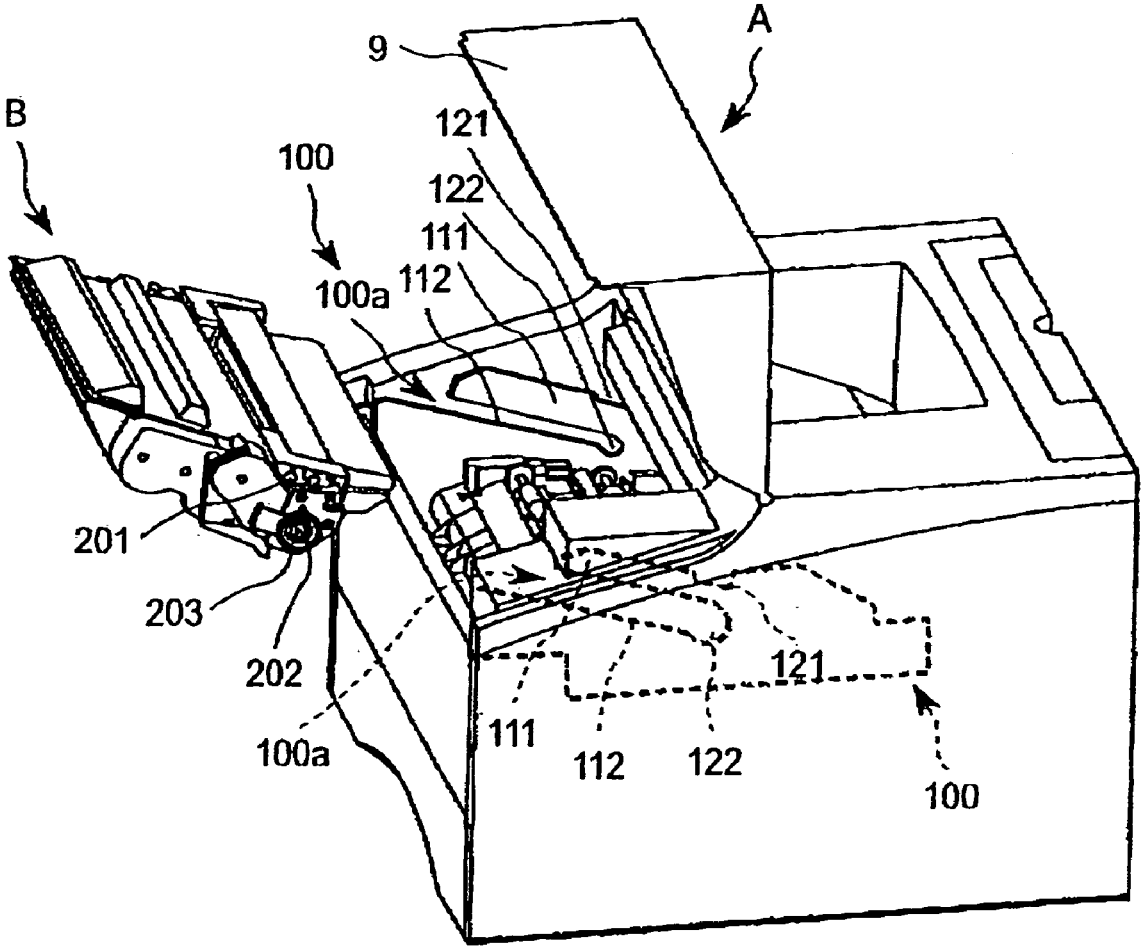
FIG. 4 is a perspective view of the main assembly of the electrophotographic image forming apparatus shown in FIG. 1, and the process cartridge shown in FIG. 2, showing how the process cartridge is mounted into, or removed from, the main assembly.

Referring to FIGS. 3 and 4, the apparatus main assembly A is provided with a door 9 for mounting or dismounting the cartridge B. The apparatus main assembly A is also provided with a pair of guides 100 as a cartridge mounting means, which are located at the left and right ends of the apparatus main assembly A, one for one, in terms of the lengthwise direction of the cartridge B in the apparatus main assembly A.

Also referring to FIGS. 3 and 4, each guide 100 is provided with a guiding portion 111 and a guiding portion 112, which are for guiding the cartridge B when the cartridge B is mounted into the apparatus main assembly A. The guiding portions 111 and 112 are parallel to the direction in which the cartridge B in mounted into the apparatus main assembly A. Each guide 100 is also provided with a cartridge positioning portion 121 and a cartridge positioning portion 122, which are for precisely locking the cartridge B into the predetermined position in the cartridge compartment 100*a* of the apparatus main assembly A. The cartridge positioning portions 121 and 122 are the downward recesses located at the deepest ends of the guides 111 and 112, respectively, in terms of the direction in which the cartridge B is mounted into the apparatus main assembly A. As for the cartridge B, it is provided with two pairs of cartridge guides 201 and 202, which are located at the lengthwise ends thereof, one pair for each end, projecting outward in the lengthwise direction of the cartridge B. The cartridge guides 201 and 202 are the portions by which the cartridge B is guided by the guides 111 and 112 on the main assembly side, respectively, when the cartridge B is mounted into the main assembly A. They fit into the aforementioned positioning recesses 121 and 122, respectively, of each guide 100 on the main assembly side, whereby the cartridge B is precisely positioned relative to the apparatus main assembly A.

With the provision of the cartridge mounting means 100, the cartridge B is removably mountable in the cartridge compartment 100*a*. The cartridge B is readied for image formation by being mounted into the cartridge compartment 100*a*.

Incidentally, while the cartridge B is mounted, the coupling 103 (FIG. 3), as a driving force transmitting portion, on the main assembly side, remains retracted, and therefore, does not interfere with the mounting of the cartridge B. Then, as the door 9 of the main assembly A is closed, the coupling 203 (FIG. 4), as a driving force receiving portion, on the cartridge side, becomes connected with the aforementioned coupling 103 on the main assembly side, making it possible for the cartridge B to receive from the apparatus main assembly A the driving force for rotating the photosensitive drum 7.

During the shipment of the cartridge B, the developer supply hole 14*d* located between the developer storage frame 14 and developing means supporting frame 13 is kept sealed by the seal 21. The developer supply hole 14*d* is the hole through which the developer stored in the developer storage frame 14 is moved into the developing means supporting frame 13. The seal 21 is to be pulled out of the cartridge B before the cartridge B is mounted into the apparatus main assembly A. With the removal of the seal 21, the developer is moved into the developing means supporting frame 13, readying thereby the image forming apparatus for image formation.

Next, referring to FIG. 5, the method for assembling the development unit 19 of the cartridge B provided with the seal 21 will be described. The methods for assembling the portions other than the development unit 19 of the cartridge B in this embodiment are the same as those which have been known.

First, the developer storage frame 14 will be described with reference to FIG. 5, which is a perspective view of the developer storage portion 14.

The developer storage frame 14 is made up of the top and bottom portions 14*a* and 14*b*, and is assembled with the use of the following method.

(1) Before joining the top and bottom portions 14*a* and 14*b* of the frame 14, the developer sending member 15 is attached inside the bottom portion 14*b* of the frame 14.

(2) The wall 14*f* (having a flat fringe area or surface) of the bottom portion 14*b* of the frame 14, which is to face the developing means supporting frame 13, is provided with the developer supply hole 14*d* through which the developer is moved into the developing means supporting frame 13. The seal 21 is welded to the wall 14*f* in a manner to seal this hole 14*d*.

(3) The flange 141*a* of the top portion 14*a* of the frame 14 is aligned with the flange 141*b* of the bottom portion 14*b*, and the welding ribs (unshown) are ultrasonically melted, welding the top and bottom portions 14*a* and 14*b* to each other to form the developer storage frame 14. The method for joining the top and bottom portions 14*a* and 14*b* of the frame 14 does not need to be limited to ultrasonic welding. For example, they may be joined by thermally welding, adhesive, or the like.

(4) Developer is poured into the developer storage frame 14 through the developer filling hole 14*e* with which one of the side walls of the bottom portion 14*b* of the frame 14 is provided, and the hole 14*e* is plugged with a cap 22 to complete the developer storage frame 14.

Also referring to FIG. 5, the sealing member 21 is welded (or pasted) to the flat fringe surface or area of the wall 14*f* of the developer supply hole 14*d* of the developer storage frame 14 in a manner to seal the developer supply hole 14*d*.

Figure 6:
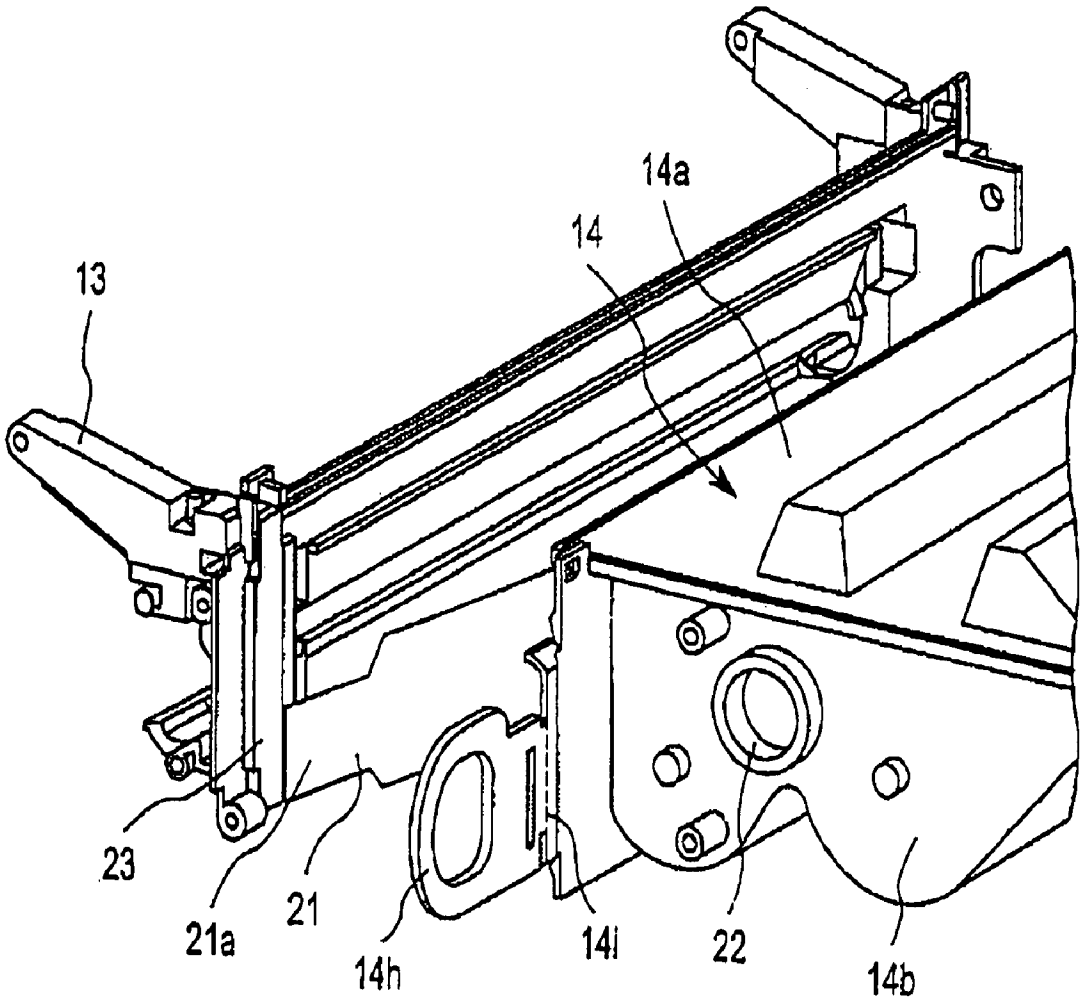
FIG. 6 is an exploded perspective view of the sealing member handle (tab) portion of the developer storage portion in accordance with the present invention.

More specifically, during the aforementioned assembly step (2), the sealing member 21 is folded back at one of the lengthwise ends of the developer supply hole 14*d*, and is overlaid back to the starting end (other lengthwise end) so that the extended portion overlaps the welded portion. Next, referring to FIG. 6, the overlaid portion is extended beyond the starting end (other lengthwise end) so that as the top and bottom portions 14*a* and 14*b* are welded together, the end portion 21*a* of the sealing member 21 will be sandwiched between an elastic seal 23 pasted to the developing means supporting frame 13 and the part of the aforementioned flat fringe surface of the wall 14*f* of the developer storage frame 14, while being exposed from the cartridge B. In other words, the overlaid portion is extended long enough for its end portion 21*a* to stick out of the cartridge B, from one of the lengthwise ends of the developing means supporting frame 13. The aforementioned elastic sealing member 23 is formed of sponge, and is pasted to the flat surface of the developing means supporting frame 13, which directly faces the developer storage frame 14.

Further, the developer storage frame 14 is provided with a sealing member removal handle (tab) 14*h*, which is located at the location at which the end portion 21*a* of the sealing member 21 is extended from the developing means supporting frame 13. The sealing member removal tab 14*h* is formed as an integral part of the developer storage frame 14, and is designed so that it can be broken away from the developer storage frame 14. In other words, the sealing member removal tab 14*h* is a virtual extension of the flat wall 14*f* of the developer storage frame 14, having the hole

14*d*, and projects outward from the lengthwise end of the developer storage frame 14 in the lengthwise direction of the developer storage frame 14. The end portion 21*a* of the sealing member 21 exposed from the development unit 19 has been attached to this sealing member removal tab 14*h* by welding, gluing, or the like method as shown in FIG. 7, which shows the sealing member removal handle (tab) portion 14*h*, which has not been bent at the connective portion 14*i*.

Figure 7:
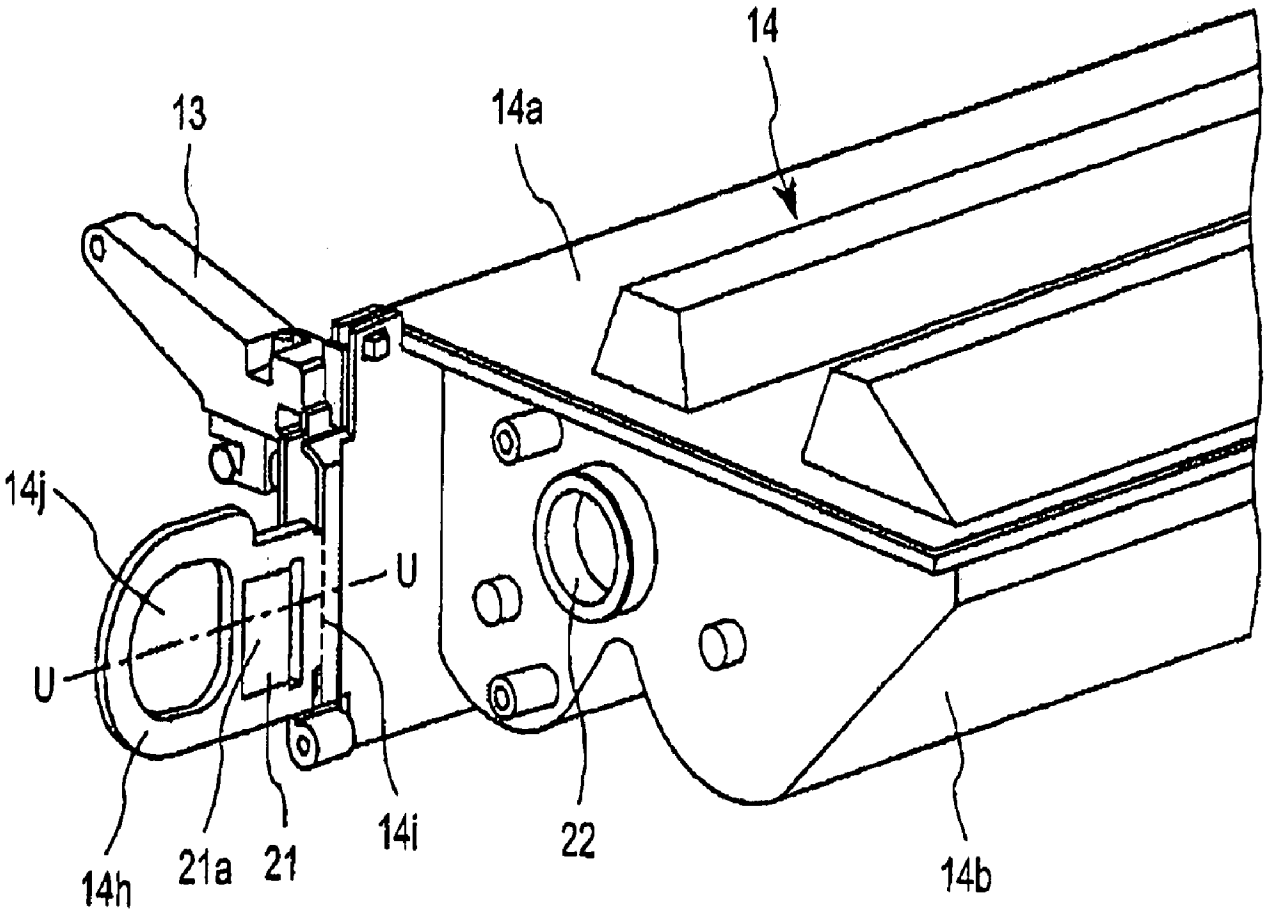
FIG. 7 is an perspective view of the partially disassembled sealing member handle (tab) portion, and its adjacencies, of the developer storage portion of the process cartridge in accordance with the present invention.
Figure 8:
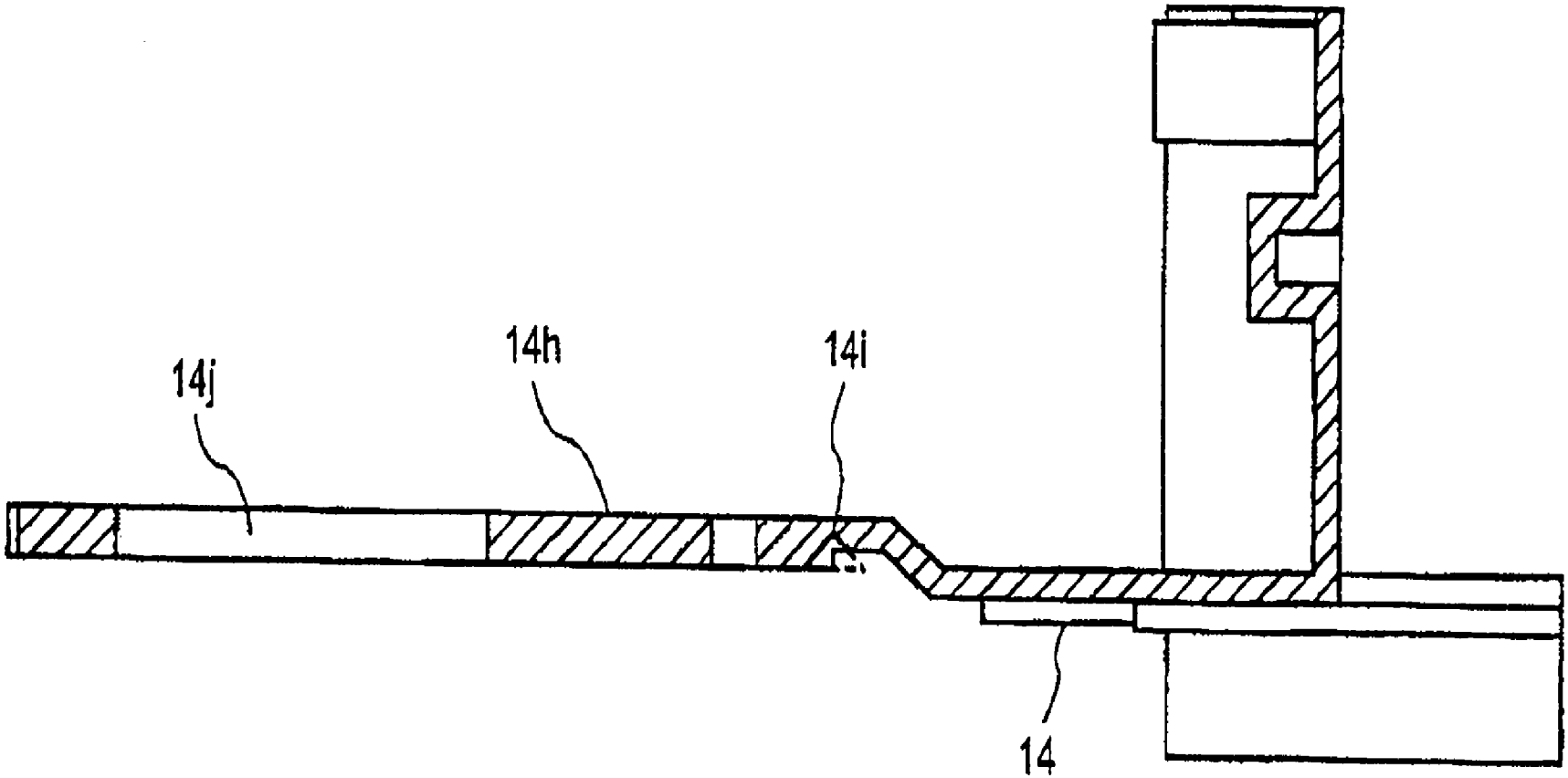
FIG. 8 is a sectional view of the sealing member handle (tab) portion, and its adjacencies, of the developer portion of the process cartridge in accordance with the present invention.

FIG. 8 is a sectional view (at line U—U in FIG. 7) of the connective portion 14*i* between the sealing member removal tab 14*h* and the main structure of the developer storage frame 14. As will be evident from FIG. 8, the connective portion 14*i* is provided with a groove with a triangular cross section, which is extended from one edge of the connective portion 14*i* to the other, in terms of the height direction of the cartridge B, making the connective portion 14*i* very thin along the bottom of the groove so that the sealing member removal handle (tab) portion 14*h* can be bent relative to the developer storage frame 14 along the groove.

Also referring to FIG. 7, the sealing member removal tab 14*h* is provided with a hole 14*j* through which a finger can be put when pulling the sealing member 21 out of the cartridge B. Into this hole 14*j*, a cartridge type differentiation member 24 or a cartridge type differentiation member 25 (FIGS. 9(*a*) and 9(*b*)) is fitted. The cartridge type differentiation members 24 and 25 are given a conspicuous color, such as orange color, in order to ensure that they are visually recognized by a user as members to be removed.

Which of the two cartridge type differentiation members 24 and 25 is fitted into the hole 14*j* is determined based on whether the cartridge B is shipped out in the apparatus main assembly A, or independently from the apparatus main assembly A. More specifically, after the completion of the aforementioned steps (1)–(4) of the developer storage frame assembly process, another step is is provided as Step (5) for attaching the cartridge type differentiation member 24 or 25 to the cartridge B depending on whether the cartridge B is of the first or second type.

Figure 9:
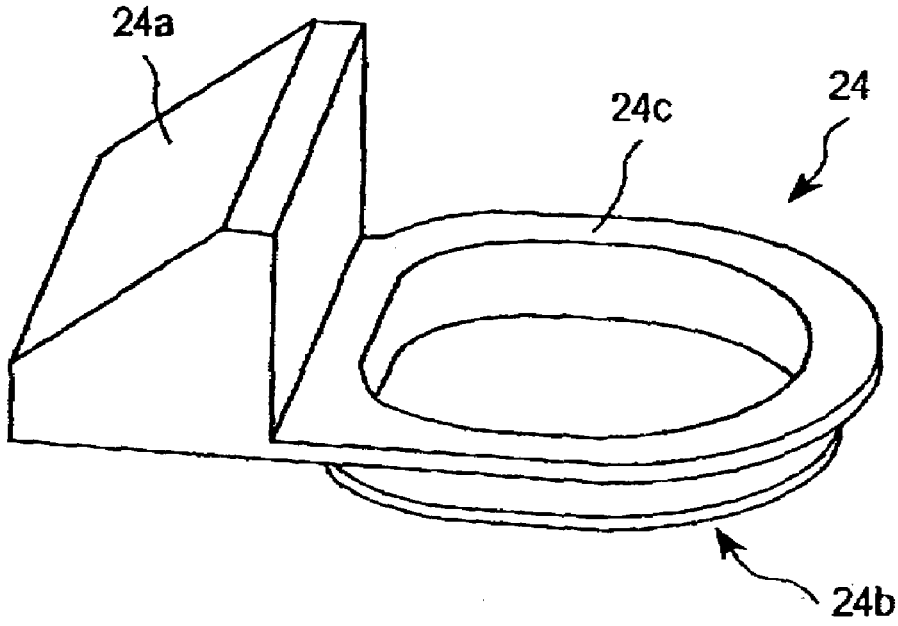
FIG. 9(*a*) is a perspective view of an example of the cartridge type differentiation member in accordance with the present invention, and FIG. 9(*b*) is a perspective view of another example of the cartridge type differentiation member in accordance with the present invention.
Figure 9:
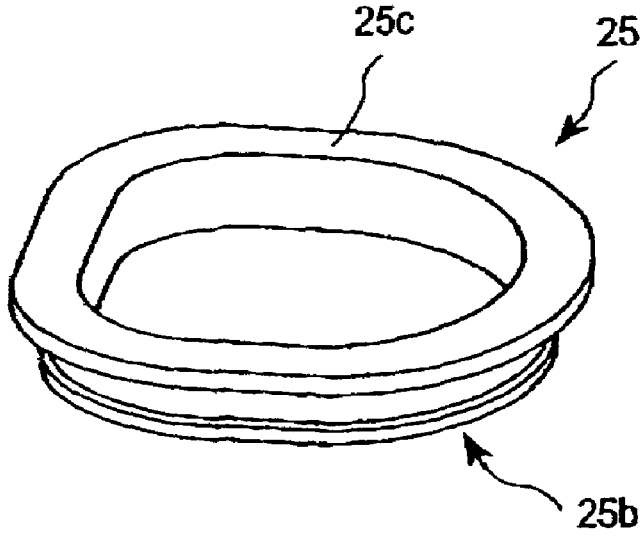
Figure 10:
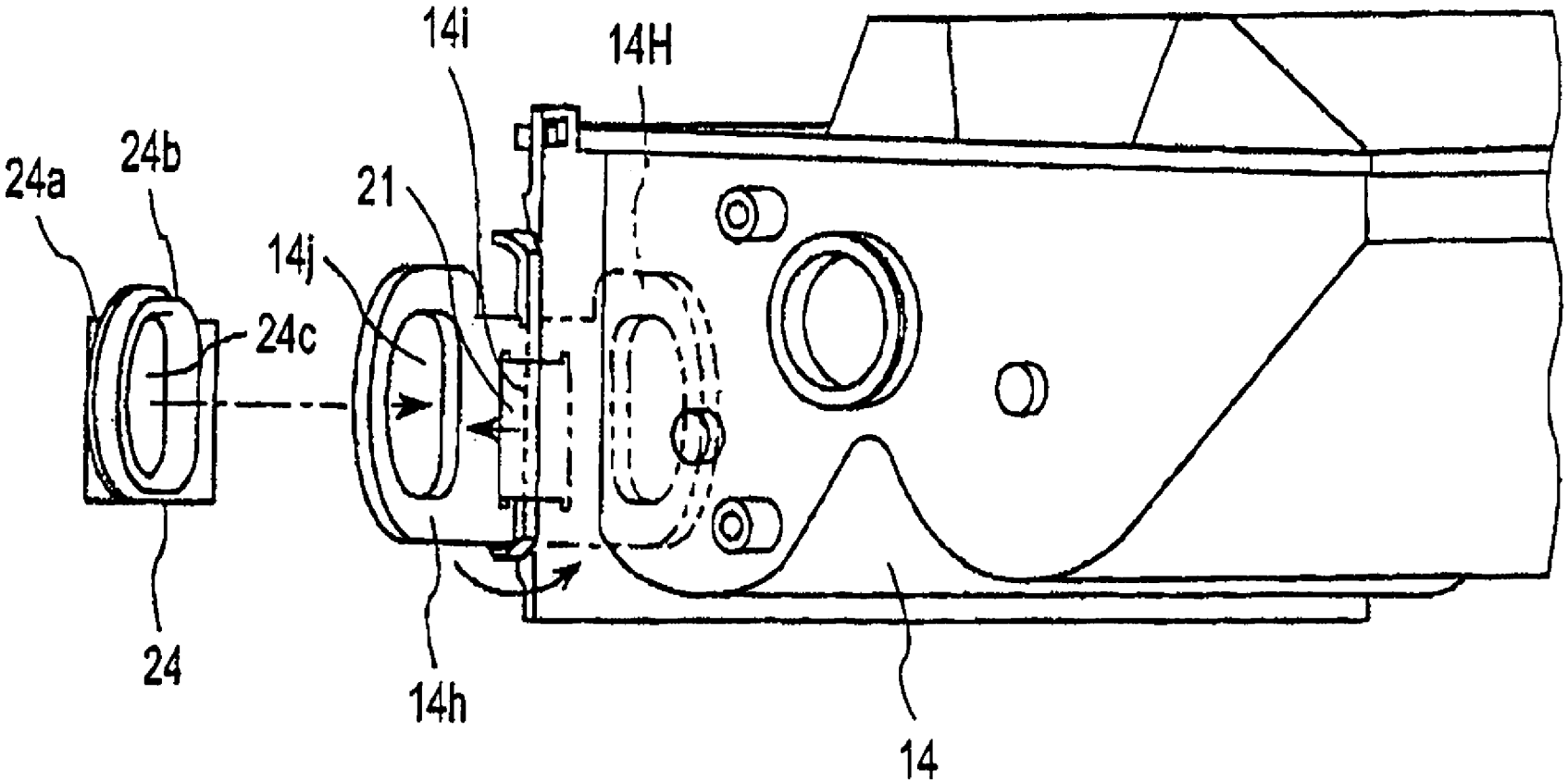
FIG. 10 is a drawing for showing the procedure for attaching the cartridge type differentiation member of a first type to the sealing member handle (tab).
Figure 11:
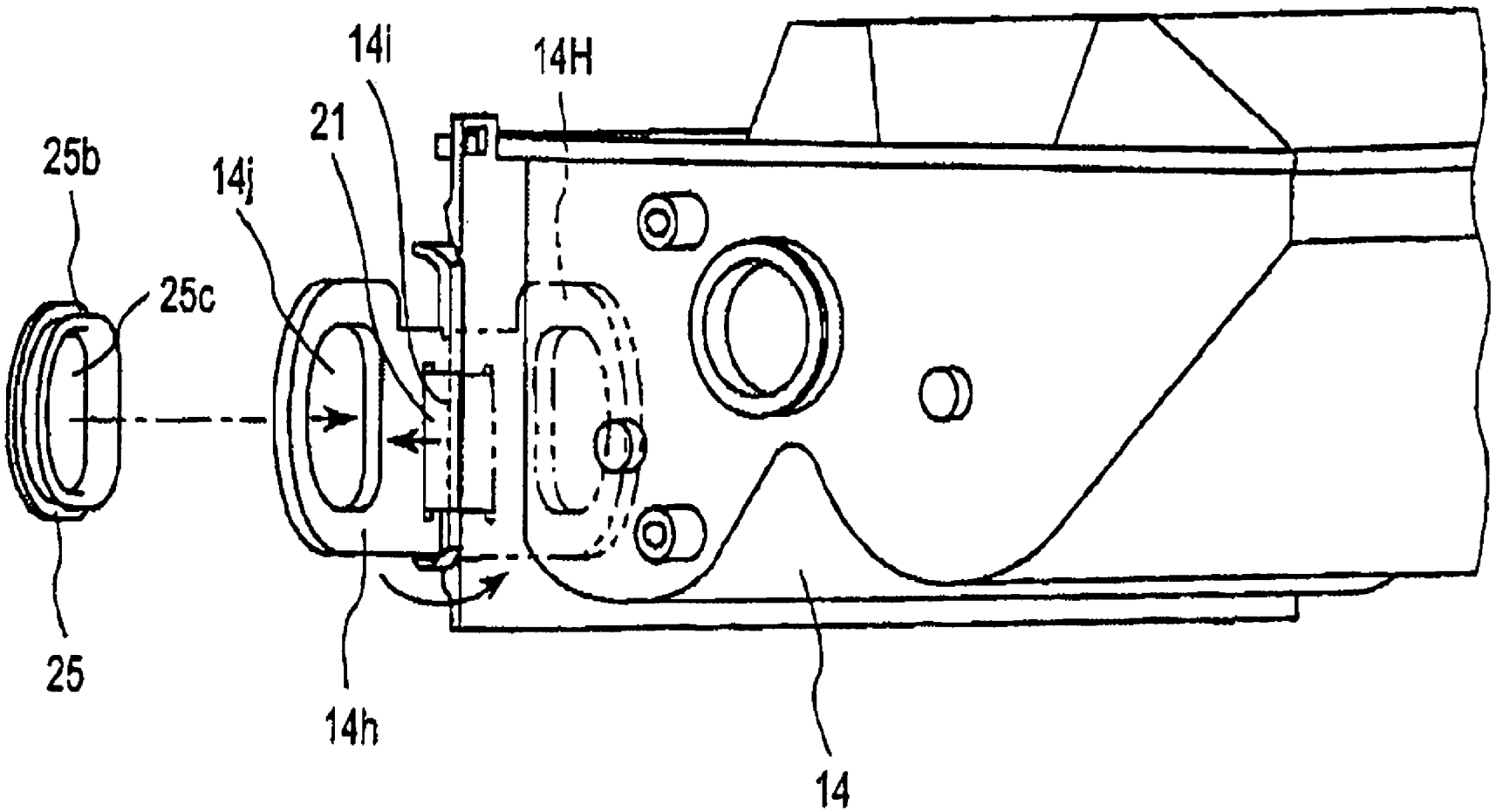
FIG. 11 is a drawing for showing the procedure for attaching the cartridge type differentiation member of a second type to the sealing member handle (tab).

In other words, the two components, shown in FIGS. 9(*a*) and 9(*b*), different in configuration are used as the cartridge type differentiation members 24 and 25. Referring to FIG. 9(*a*), the cartridge type differentiation member 24 of a first type has a fastening portion 24*b*, virtually in the form of a ring, which is fitted into the hole 14*j* of the sealing member removal tab 14*h*, a regulating portion 24*a*, and actual cartridge type differentiation member portion 24*c*, which are integral parts of the cartridge type differentiation member 24 of the first type, and are formed of resin. The portion 24*b* is structured so that it can be removably fitted into the hole 14*j* of the sealing member removal tab 14*h*. The regulating portion 24*a* is a protuberant portion with a length greater than a predetermined length, and is connected to the periphery of the fastening portion 24*b* in the form of a ring. The actual cartridge type differentiation member portion 24*c* is where a finger is placed to pull the cartridge type differentiation member 24. Next, referring to FIG. 9(*b*), the cartridge type differentiation member 25 of a second type is not provided with the regulating portion 24*a* with which the first type cartridge type differentiation member 24 is provided. In other words, the second type cartridge type differentiation member 25 has only the fastening portion 25*b*, which is removably fitted into the hole 14*j* of the sealing member removal tab 14*h* to removably attach the second type cartridge type differentiation member 25 to the sealing member removal tab 14*h*, and the actual cartridge type differentiation member portion 25*c* where a finger is placed to pull the sealing member 21 by the sealing member removal tab 14*h*. Next, referring to FIGS. 10 and 11, when attaching the cartridge type differentiation member 24 or 25 to the sealing member removal tab 14*h*, the fastening portions 24*b* or 25*b* of the cartridge type differentiation member 24 or 25, respectively, is fitted into the hole 14*j* of the sealing member removal tab 14*h*. After the cartridge type differentiation member 24 or 25 is fitted into the hole 14*j* of the sealing member removal tab 14*h*, the sealing member removal tab 14*h* is bent by 90 degrees along the groove 14*i* (folding line) so that the sealing member removal tab 14*h* is folded against the side wall of the developer storage frame 14 (state 14H in FIGS. 10 and 11) as contoured by the broken line in FIGS. 10 and 11. Unless it is when the sealing member 21 is to be pulled out, the sealing member removal tab 14*h* is kept in this state (14H) contoured by the broken line. The line 14*i*, along which the sealing member removal tab 14*h* is bent relative to the side wall of the developer storage frame 14, coincides with the bottom of the aforementioned groove of the connective portion 14*i*. Incidentally, when pulling out the sealing member 21, the sealing member removal tab 14*h* is unbent along the folding line 14*i*.

When the cartridge B is prepared as the first type cartridge, which is shipped out independently from the apparatus main assembly A, the cartridge type differentiation member 24, that is, the cartridge type differentiation member having the regulating portion 24*a*, is attached to the sealing member removal tab 14*h* of the cartridge B, in the aforementioned Step (5) so that the insertion of the cartridge B into the apparatus main assembly A is regulated. On the other hand, when the cartridge B is prepared as the second type cartridge, which is shipped out in the apparatus main assembly A, the cartridge type differentiation member 25, that is, the cartridge type differentiation member with no regulating portion 24*a*, is attached to the sealing member removal tab 14*h* in the aforementioned Step (5).

Figure 12:
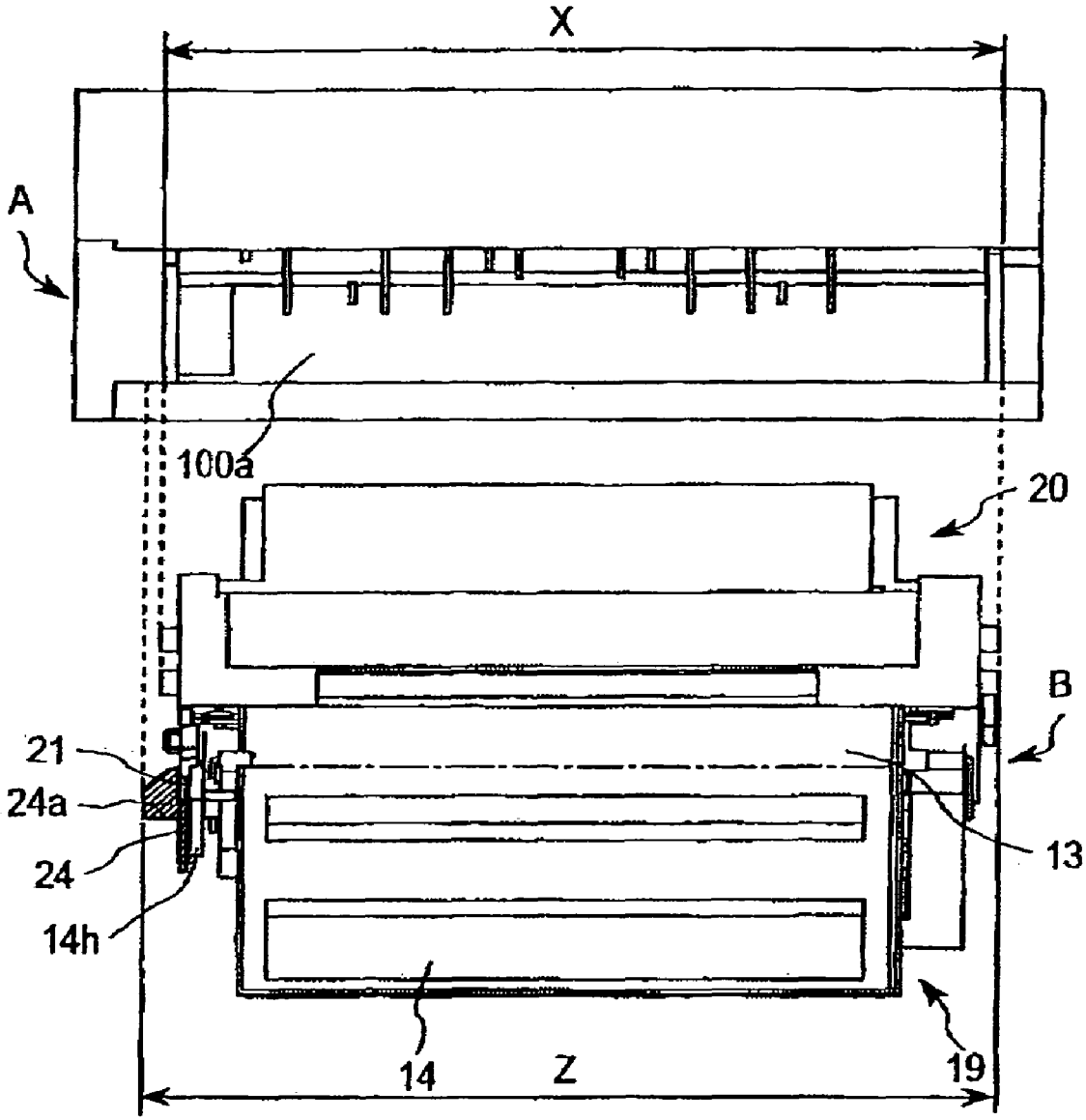
FIG. 12 is a drawing for showing the relationship, in terms of dimensions, between the process cartridge and the cartridge compartment in the main assembly of an electrophotographic image forming apparatus, in terms of the lengthwise direction of the process cartridge.

Referring to FIG. 9(*a*), the regulating portion 24*a* of the cartridge type differentiation member 24 projects in the direction perpendicular to the top surface (in FIG. 9) of the sealing member removal tab 14*h*, with the base line of the regulating portion 24*a* of the cartridge type differentiation member 24 coinciding with the top surface of the cartridge type differentiation member fastening portion 14*b*. With the sealing member removal tab 14*h* folded flat on the side wall of the developer storage frame 14, the regulating portion 24*a* projects farthest outward from the developer storage frame 14 (cartridge B) in the lengthwise direction of the cartridge B (direction Ointersectional to direction in which cartridge B is mounted into apparatus main assembly A). FIG. 12 shows the dimensional relationship between the cartridge compartment 100*a* of the apparatus main assembly A, and the cartridge B, in terms of the lengthwise direction of the cartridge B. In this embodiment, the developer storage frame 14 is structured so that the dimension X of the cartridge compartment 100*a* in the apparatus main assembly A is less than the dimension Z of the cartridge B, in terms of the lengthwise direction of the cartridge B.

Therefore, when the first type cartridge type differentiation member 24 is employed, the cartridge B is prevented from being mounted into the apparatus main assembly A, preventing thereby a user from forgetting to pull out the sealing member 21. Therefore, the first type cartridge type differentiation member 24 is used with the first type cartridge, or the cartridge B which is to be shipped out independently from the apparatus main assembly A.

Figure 13:
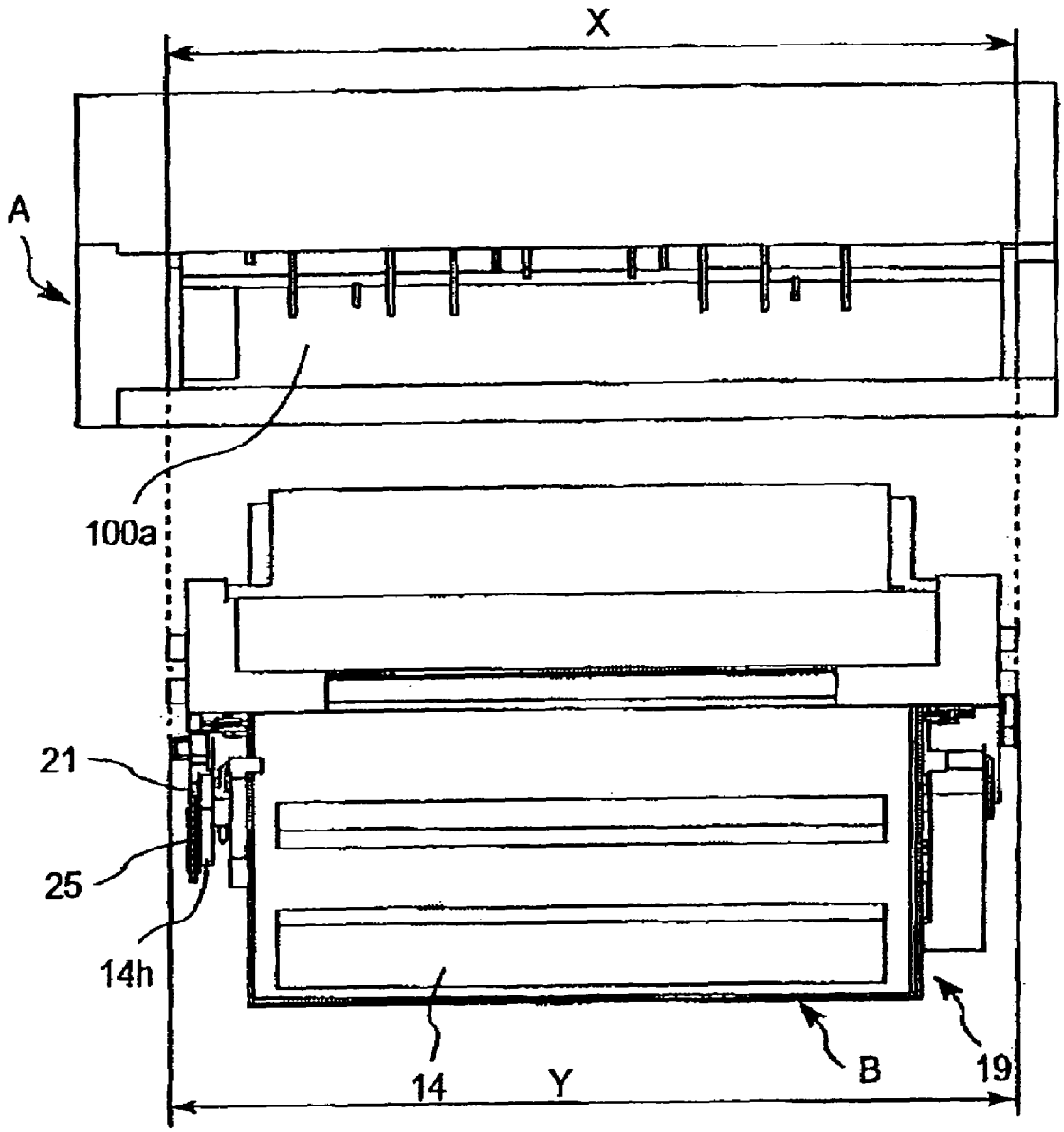
FIG. 13 is a drawing for showing the relationship, in terms of dimensions, between the process cartridge and the cartridge compartment in the main assembly of an electrophotographic image forming apparatus, in terms of the lengthwise direction of the process cartridge.

In comparison, with the cartridge type differentiation member 25 attached to the sealing member removal tab 14*h* as shown in FIG. 13, the dimension X of the cartridge compartment 100*a* in the apparatus main assembly A is not less than the dimension Y of the cartridge B, in terms of the lengthwise direction of the cartridge B.

Therefore, when the cartridge type differentiation member 25 is employed, the cartridge B can be mounted into the apparatus main assembly A, with the cartridge type differentiation member 25 remaining attached to the cartridge B, making it possible to raise the level of efficiency at which the apparatus main assembly A is shipped out with the cartridge B mounted therein. In other words, the second type cartridge type differentiation member 25 is employed to prepare the cartridge B as the second type cartridge, or the cartridge mounted before the apparatus main assembly A is shipped out.

As described above, in this embodiment, the cartridge B is provided with a sealing member removal tab 14*h*, to which one end of the sealing member 21 is attached, and the two kinds of cartridge type differentiation members 24 and 25, which are to be attached to the sealing member removal tab 14*h*, are selectively employed. Therefore, the frame 14 itself of the cartridge B does not need to be structured so that the frame 14 itself will prevent or allow the mounting of the cartridge B into the apparatus main assembly A. In other words, it is unnecessary to prepare two kinds of cartridge frame molds, which are much larger than the two kinds of cartridge type differentiation member molds, reducing thereby the production cost of the cartridge B. This, in turn, can reduce the maintenance cost of the printer 200, and also, can raise the operational efficiency of the printer 200. Moreover, in the case of the cartridge B of the second type, that is, the cartridge B mounted into the apparatus main assembly A before the apparatus main assembly A is shipped out, the cartridge type differentiation member 24, which is of a conspicuous color, is exposed from the cartridge B, making it easier for an operator to recognize that the sealing member 21 is remaining attached. Therefore, it is less likely to occur that the operator forgets to pull out the sealing member 21.

Embodiment 2

Next, referring to FIGS. 14 and 15, the second embodiment of the present invention will be described. Incidentally, the components, structural arrangements, etc., of the cartridge B in this embodiment, which are the same as those in the first embodiment, will not be described.

Figure 14:
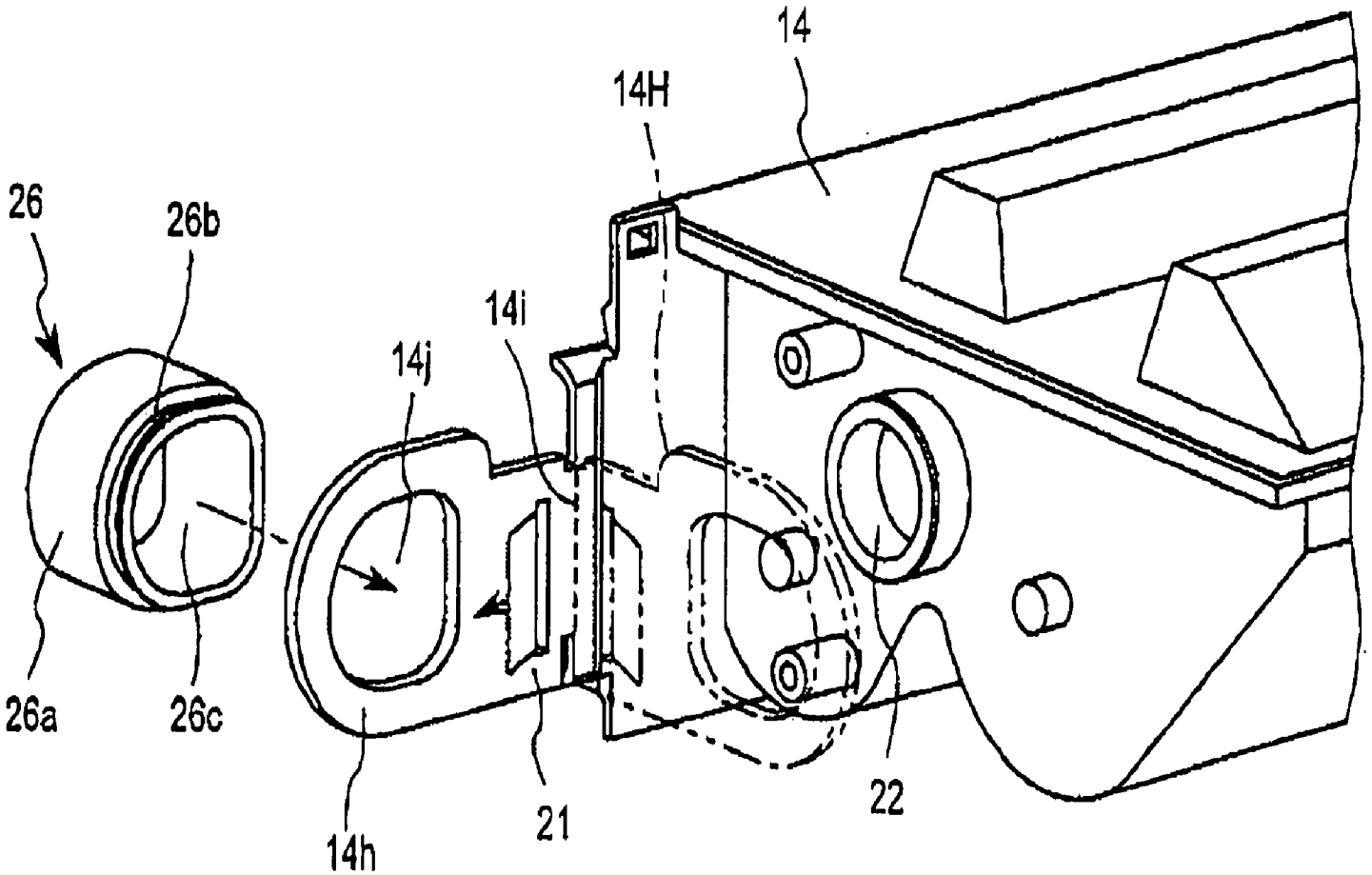
FIG. 14 is a drawing for showing the procedure for attaching another example of the cartridge type differentiation member to the sealing member handle (tab) portion of the process cartridge.
Figure 15:
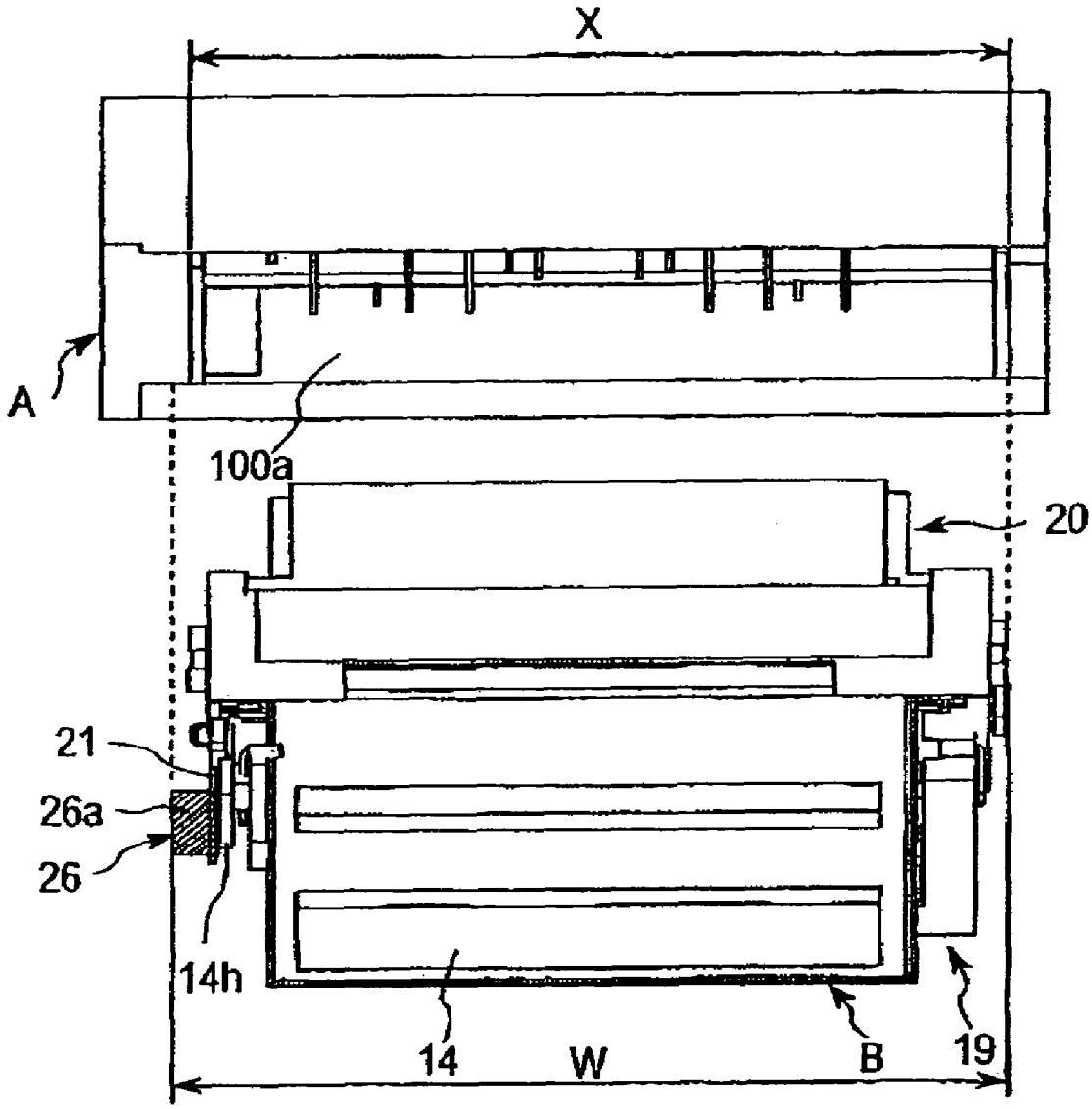
FIG. 15 is a drawing for showing the relationship, in terms of dimensions, between the process cartridge and the cartridge compartment in the main assembly of an electrophotographic image forming apparatus, in terms of the lengthwise direction of the process cartridge.

Referring to FIG. 14, the sealing member removal tab 14*h* is provided with a hole 14*j* through which a finger is put when an operator peels away the developer seal 21, and into which the cartridge type differentiation member 26 is fitted. The cartridge type differentiation member 26 is given a conspicuous color, for example, an orange color, so that it can be visually recognized as a member to be removed by a user.

The cartridge identification member 26 of the first type, in this embodiment, is provided with a projection (regulating portion) 26*a*. Therefore, as the sealing member removal tab 14*h* is bent along the folding line 14*i* in a manner to fold the tab 14*h* onto the side wall of the developer storage frame 14 as contoured by the broken line 14H in FIG. 14, the regulating portion 26*a* projects from the cartridge B in terms of the lengthwise direction of the cartridge B. In other words, with the sealing member removal tab 14*h* fitted with the cartridge identification member 26, and folded against the side wall of the developer storage frame 14, the dimension X of the cartridge compartment 100*a* of the apparatus main assembly A is less than the dimension W of the cartridge B, in terms of the lengthwise direction of the cartridge B. Incidentally, when the sealing member 21 is pulled out, the sealing member removal tab 14*h* is unbent, causing the seal grip portion 26*c* of the cartridge identification member 26, through which a finger is put to pullout the seal 21, to be positioned so that the axial line of the grip portion 26*a* becomes perpendicular to the lengthwise direction of the cartridge B.

In other words, in the case of the cartridge identification member 24 in the first embodiment, the regulating portion 24*a* for preventing the cartridge B from being mounted into the apparatus main assembly A is attached to the periphery of the fastening portion 24*b*. However, in the case of the cartridge identification member 26 in this embodiment, the regulating portion 26*a* is the extension of the fitting portion 26*b* in terms of the axial line of the fastening portion 26*b*.

As described above, fitting the sealing member removal tab 14*h* with the cartridge identification member 26 of the first type make it impossible to mount the cartridge B into the apparatus main assembly A, preventing thereby a user from forgetting to pull out the sealing member 21. In comparison, fitting the sealing member removal tab 14*h* with the cartridge differentiation member 25 allows the cartridge B to be mounted into the apparatus main assembly A, raising the level of efficiency with which the apparatus main assembly A is shipped out. In other words, the second embodiment of the present invention offers the same effects as those offered by the first embodiment.

As will be evident from the above descriptions of the first and second embodiments of the present invention, the sealing member removal tab 14*h* can be fitted with one of the plurality of cartridge differentiation members different in shape. In other words, the sealing member removal tab 14*h* may be fitted with one of the cartridge differentiation members different in shape from those in the first and second embodiments, based on the type of cartridge usage.

Embodiment 3

Figure 16:
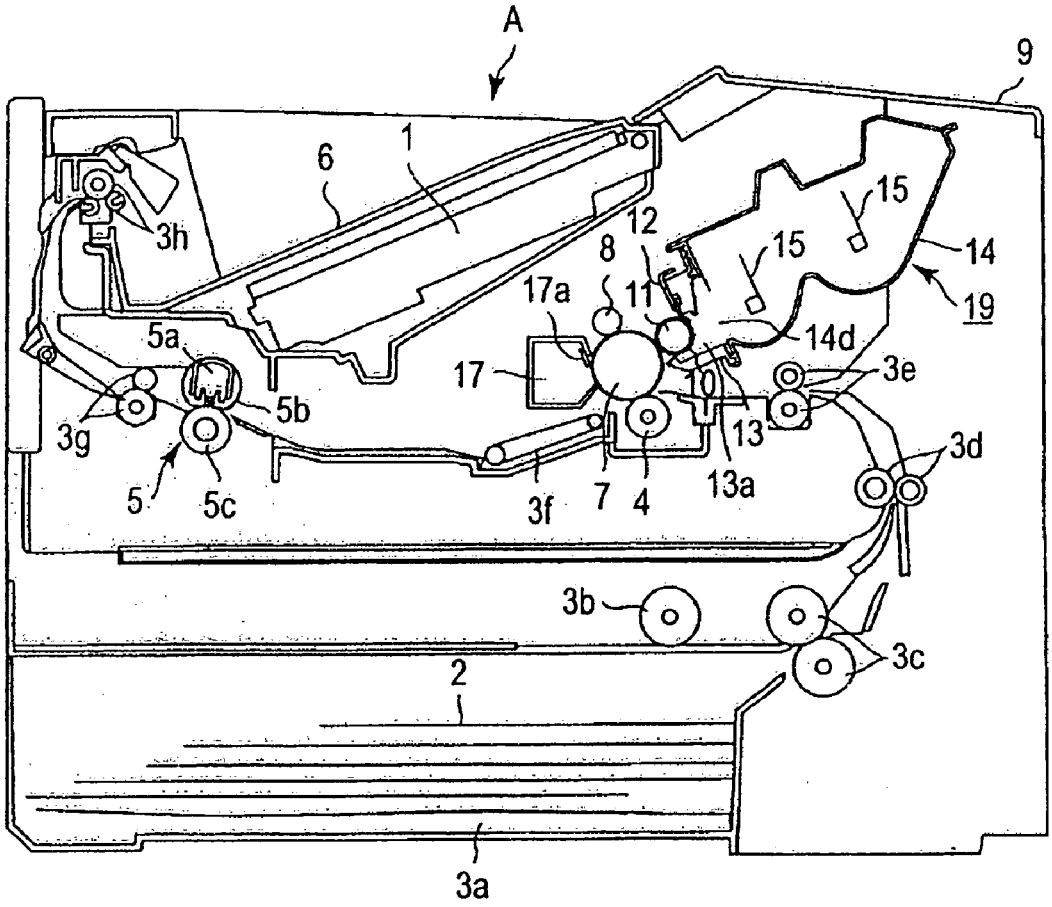
FIG. 16 is a sectional view of the electrophotographic image forming apparatus comprising the development cartridge in accordance with the present invention, showing the general structure thereof.

Referring to FIG. 16, the image forming operation carried out by the electrophotographic image forming apparatus in this embodiment is the same as that in the first embodiment. However, in the case of the electrophotographic image forming apparatus in this embodiment the aforementioned image forming means, which carry out the image formation process, are not integrated with the photosensitive drum 7, in the form of a process cartridge. In other words, the image forming means are made physically independent from the photosensitive drum 7. More specifically, the development unit 19 comprising the developing means, developing means supporting frame 13, and developer storage frame 14 is in the form of a development cartridge (19). Therefore, the developing unit 19, which was described in the description of the first embodiment, can be removably mounted into the apparatus main assembly A independently from the photosensitive drum 7.

Also in the case of the development cartridge (19) employed by an image forming apparatus of this type, there is provided a developer supply hole 14*d* between the developing means supporting frame 13 and developer storage frame 14 of the development cartridge (19). Also, the development cartridge (19) is provided with a sealing member 21 for keeping the developer supply hole 14*d* sealed, and a sealing member removal tab 14*h*, which is for pulling the sealing member 21 out of the development cartridge 19, and which can be fitted with the cartridge type differentiation member 24, 25, or the like. The structures of the sealing member 21, sealing member removal tab 14*h*, cartridge type differentiation members 24, 25, or the like, in this embodiment, are the same as those in the above described first embodiment. Therefore, the development cartridge (19) can be selectively readied either as a development cartridge to be shipped out independently from the main assembly of an electrophotographic image forming apparatus, or a development cartridge to be shipped out in the main assembly of an electrophotographic image forming apparatus, simply by selecting the cartridge type differentiation member with which the sealing member removal tab is fitted.

As will be evident from the above description of this embodiment, the present invention is also applicable to an image forming apparatus which employs a removably mountable development cartridge.

The measurements, materials, configurations, etc., of the structural members of the process cartridge, development cartridge, sealing member removal tabs, cartridge type differentiation members, and the positional relationship among them, in the above described preferred embodiments of the present invention are not intended to limit the scope of the present invention, unless specifically noted. Neither the image forming apparatuses in the above described embodiments of the present invention are intended to limit the scope of the present invention. It should be noted here that some cartridges may not have a cleaning means and/or a charging means.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 055433/2004 filed Feb. 27, 2004, which is hereby incorporated by reference.

What is claimed is:

1. A process cartridge detachably mountable to a main assembly of an electrophotographic image forming apparatus, said process cartridge comprising:

an electrophotographic photosensitive drum;

a developing device configured and positioned to develop an electrostatic latent image formed on said electrophotographic photosensitive drum;

a developer accommodating portion configured to accommodate a developer to be used for development of the electrostatic latent image;

a developer supply opening, provided in said developer accommodating portion, configured and positioned to supply the developer from said developer accommodating portion to said developing device;

a sealing member configured and positioned to unsealably seal said developer supply opening; and a grip member mounting portion configured and positioned to mount a first grip member or a second grip member configured and positioned to be gripped to pull out said sealing member to unseal said developer supply opening, wherein said grip member mounting portion is mounted to one end of said sealing member, wherein on said grip member mounting portion, said first grip member or said second grip member is mountable, wherein said first grip member is provided with a stopper portion configured and positioned to prevent said process cartridge from entering the main assembly of the apparatus by abutting a part of the main assembly when said process cartridge is being mounted to the main assembly of the apparatus with said sealing member mounted on said process cartridge, wherein said second grip member permits said process cartridge to enter the main assembly of the apparatus with said sealing member mounted on said process cartridge.

2. A process cartridge according to claim 1, wherein said first grip member and said second grip member have hook portions configured and positioned to be hooked by a finger of a user of said process cartridge, wherein said stopper portion of said first grip member has a projected portion projecting in a direction crossing a mounting direction in which said process cartridge is mounted to the main assembly of the apparatus, and wherein said hook portion of said first grip member and said stopper portion are an integrally molded member made of resin material.

3. A process cartridge according to claim 1 or 2, wherein either one of said first grip member and said second grip member is selectively mounted on said grip member mounting portion.

4. A developing cartridge detachably mountable to a main assembly of an electrophotographic image forming apparatus, said developing cartridge comprising:

a developing device configured and positioned to develop an electrostatic latent image formed on an electrophotographic photosensitive drum;

a developer accommodating portion configured to accommodate a developer to be used for development of the electrostatic latent image;

a developer supply opening, provided in said developer accommodating portion, configured and positioned to supply the developer from said developer accommodating portion to said developing device;

a sealing member configured and positioned to unsealably seal said developer supply opening; and a grip member mounting portion configured and positioned to mount a first grip member or a second grip member configured and positioned to be gripped to pull out said sealing member to unseal said developer supply opening, wherein said grip member mounting portion is mounted to one end of said sealing member, wherein on said grip member mounting portion, said first grip member or said second grip member is mountable, wherein said first grip member is provided with a stopper portion configured and positioned to prevent said developing cartridge from entering the main assembly of the apparatus by abutting a part of the main assembly when said developing cartridge is being mounted to the main assembly of the apparatus with said sealing member mounted on said developing cartridge, wherein said second grip member permits said developing cartridge to enter the main assembly of the apparatus with said sealing member mounted on said developing cartridge.

5. A developing cartridge according to claim 4, wherein said first grip member and said second grip member have hook portions configured and positioned to be hooked by a finger of a user of said developing cartridge, wherein said stopper portion of said first grip member has a projected portion projecting in a direction crossing a mounting direction in which said developing cartridge is mounted to the main assembly of the apparatus, and wherein said hook portion of said first grip member and said stopper portion are an integrally molded member made of resin material.

6. A developing cartridge according to claim 4 or 5, wherein either one of said first grip member and said second grip member is selectively mounted on said grip member mounting portion.

* * * * *

UNITED STATES PATENT AND TRADEMARK OFFICE

CERTIFICATE OF CORRECTION

PATENT NO. : 7,206,534 B2
APPLICATION NO. : 10/968020
DATED : April 17, 2007
INVENTOR(S) : Ryuta Murakami It is certified that error appears in the above-identified patent and that said Letters Patent is hereby corrected as shown below:

ON THE TITLE PAGE, AT ITEM (47), ABSTRACT
Line 9, "a for" should read --a sealing member for--.

COLUMN 1
Line 18, "apparatus for" should read --an apparatus for--.

COLUMN 2
Line 14, "need rose" should read --need arose--.

COLUMN 10
Line 43, "Ointersectional" should read --intersectional--.

Signed and Sealed this

Fifth Day of August, 2008

JON W. DUDAS
*Director of the United States Patent and Trademark Office*